US006018919A

United States Patent [19]

Bodine

[11] Patent Number: 6,018,919

[45] Date of Patent: Feb. 1, 2000

[54] SMOOTH WALL FINISHING SYSTEM

[75] Inventor: Darryl C. Bodine, Lancaster, Pa.

[73] Assignee: Armstrong World Industries, Inc., Lancaster, Pa.

[21] Appl. No.: 08/726,357

[22] Filed: Oct. 4, 1996

[51] Int. Cl.[7] ..... E04B 2/00

[52] U.S. Cl. ..... 52/506.01; 52/746.1

[58] Field of Search ..... 52/1, 311.1, 364, 52/366, 393, 746.1, 256, 259; 156/71

[56] References Cited

U.S. PATENT DOCUMENTS 2,876,893 3/1959 Blackford et al. ..... 206/412
3,464,178 9/1969 Deichert et al. ..... 52/309.1
3,990,929 11/1976 Evans ..... 156/71
4,159,219 6/1979 Evans ..... 156/71
4,698,258 10/1987 Harkins ..... 428/285

*Primary Examiner*—Beth Aubrey
*Attorney, Agent, or Firm*—Womble Carlyle Sandridge & Rice, PLLC

[57] ABSTRACT

The invention is a wall finishing system which is a sheet material designed to cover an entire wall, requiring minimal seams. The wall material has the characteristic of shrinking after application causing surface irregularities to pull out to a smooth plane. The sheet material can be applied to various substrates including finished or unfinished drywall, paneling, cement block, etc.

5 Claims, 1 Drawing Sheet

SMOOTH WALL FINISHING SYSTEM

BACKGROUND OF THE INVENTION

FIELD OF THE INVENTION

The invention is directed to provide a material and method for finishing unfinished or damaged wall substrates. The use of this invention results in a smooth plaster-like wall surface.

U. S. Pat. Nos. 3,941,632 and 4,698,258 show structures applied to walls without a shrinking effect.

SUMMARY OF THE INVENTION

Current methods for finishing wall surfaces include: traditional applied plaster, tape and joint compound, heavy texture wall coverings and heavy texture paint. Methods to achieve a smooth plaster finish are messy, require a certain skill level, and often require several days for application and drying time. Methods that utilize heavy texture as a means of hiding surface irregularity are often unacceptable to the home owner for various reasons—too rough, not easily wall papered, looks unfinished. The invention is a sheet material that covers the entire wall surface and bridges substrate irregularities by shrinking to a tight smooth surface.

The invention is a wall finishing system that provides a smooth flat pre-finished surface that can be painted, papered or left as applied. The invention is designed to apply to a wide array of wall substrates and situations. The invention consists of a sheet material, designed to shrink after application to a wall and an attachment method such as adhesive, double-faced adhesive carpet tape, staples (staples are covered with trim). The sheet material is manufactured on a release paper which is removed prior to installation of the sheet to a wall. The sheet material can be trimmed to fit the wall prior to application or in some cases trimmed out after application. The shrink characteristic of the material allows the application to the wall to be less than perfectly smooth as the material will shrink tight to a smooth fit.

The invention, being capable of installing in one day, is especially useful for wall finishing situations where the room being finished cannot accommodate the several day process associated with conventional tape and compound finishing. The invention is also useful in situations where reoccurring settling cracks are a problem. The material acts as a flexible membrane that allows for movement without sacrificing surface continuity.

This finishing system is ideal for manufactured housing applications because large wall sections can be finished in the factory and then survive subsequent transport and assembly.

In residential basement applications, the material may be applied directly over block walls, poured walls, old paneling and other common substrates to quickly transform the walls to smooth plaster looking walls.

DESCRIPTION OF THE INVENTION

The invention is a wallcovering 2 designed to be a wall finishing system that can provide a smooth flat finish to a variety of possible wall substrates such as drywall 4, block and paneling. The wallcovering material would be available in rolls and range in size of widths from 6' to 14' and lengths of any size (limited only by handling realities). The material thickness would be about 0.020" to 0.060". The material is made from a PVC compound formulated to meet code requirements. The sheet is manufactured on a release paper which is removed prior to installation. The release paper may be used to pattern scribe the wall, assisting in sizing the PVC sheet for wall application. The actual technique of handling and positioning this material would be similar to applying carpet or flooring materials to a floor, but in this case, a wall is the plane of application. The sheet material forming the wallcovering is made according to the disclosure of U.S. Pat. No. 4,159,219. The vinyl resin-containing layer (column 2, lines 34–44) of the floor product of the above patent are used as the wall covering material (shrinkable sheet material) used herein. The wallcovering material is normally made with a smooth plain white face.

An entire wall can be finished using this system and in most cases without any seams interrupting the wall plane. The material can be attached to the substrate using adhesive 6, carpet tape, or staples along the perimeter, around openings and at high spots. The means to fasten the wallcovering can be perimeter fastening or perimeter and high spot fastening. No fastening is done to low spots. After being secured to the substrate the material will shrink causing it to tightly "drum" across the wall plane resulting in a smooth flat surface, covering the low spots, that may be painted or left as is (standard white opague finish).

Figure 1:
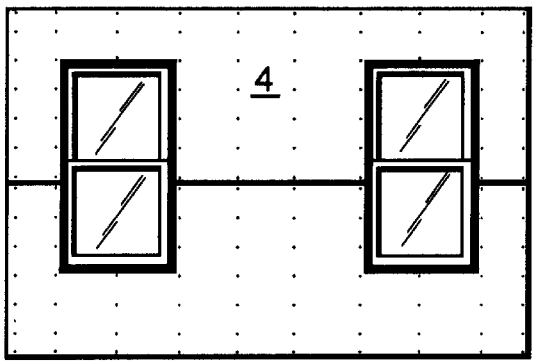
FIG. 1 is a front view of the unfinished drywall installed.
Figure 2:
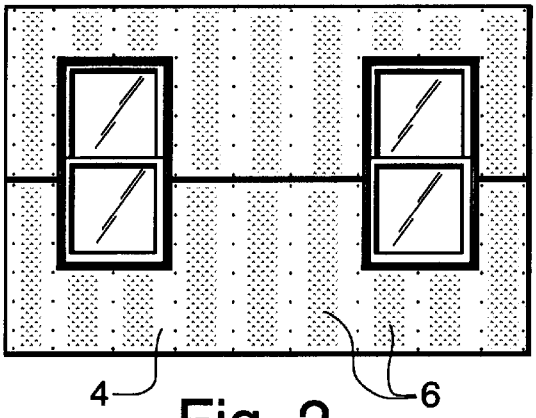
FIG. 2 is a front view of FIG. 1 with the adhesive applied.
Figure 3:
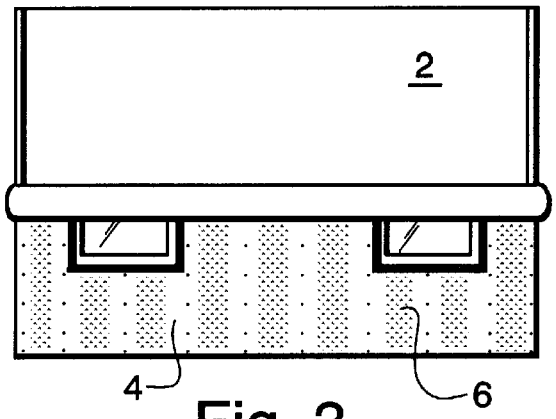
FIG. 3 is a front view of FIG. 2 with the finishing system partly applied.
Figure 4:
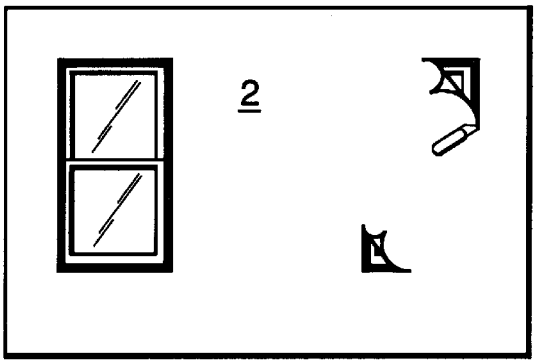
FIG. 4 is a front view of the installed finishing system with one window exposed.
Figure 5:
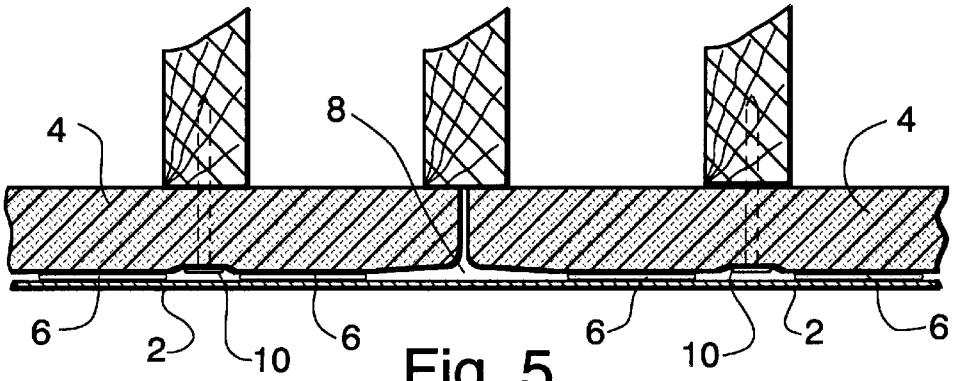
FIG. 5 is a top view of the finishing system on drywall.

FIG. 5 shows the wallcovering 2 held by adhesive 6 to the face of drywall 4 (or cement blocks). The wallcovering conceals the nails 10 in depressed areas and the gap 8 between adjacent sections of drywall or cement blocks.

The invention is intended to provide the ability to produce a finished wall without requiring numerous preparation steps and to provide this finish to a variety of different substrates. Currently different substrates require both unique and different approaches to finishing. For example, block walls can be skim coated with plaster or furred out and drywalled, taped and spackled (either way, the finishing procedure will require two to three days). The present invention would simply be trimmed to fit the wall and applied, as shown in the drawings, attached with adhesive.

What is claimed is:

1. A smooth wall finishing system which is designed to cover wall substrates which have a non-smooth surface comprising:

(a) a non-smooth surface wall substrate with high and low spots thereon; and (b) an opaque shrinkable sheet means fastened to the high spots on the non-smooth surface wall substrate, wherein the shrinkable sheet means will shrink after fastening to the high spots and conceal the low spots.

2. The smooth wall finishing system as set forth in claim 1 wherein the shrinkable sheet means is a plastic sheet.

3. The smooth wall finishing system as set forth in claim 1 wherein the shrinkable sheet means is fastened to the wall substrate with adhesive, carpet tape, or staples.

4. A method of covering non-smooth wall surfaces to provide a smooth surface comprising the steps of:

(a) providing a non-smooth wall surface with high and low spots thereon within its perimeter;

(b) applying an adhesive means to the perimeter of the wall surface; and (c) securing an opaque shrinkable sheet means to the perimeter adhesive means wherein the shrinkable sheet means will shrink after being secured and cover the low spots on the non-smooth wall surface to provide a smooth surface.

5. A method of covering non-smooth wall surfaces to provide a smooth surface comprising the steps of:

(a) providing a non-smooth wall surface with high and low spots thereon within its perimeter; and (b) securing an opaque shrinkable sheet means to the non-smooth wall surface wherein the shrinkable sheet means will shrink after being secured and cover the low spots on the non-smooth wall surface to provide a smooth surface.

* * * * *